United States Patent [19]

Webb

[11] Patent Number: 4,713,893

[45] Date of Patent: Dec. 22, 1987

[54] THERMAL DRYER CONTROL SYSTEM

[75] Inventor: Frederick A. Webb, Bethel Park, Pa.

[73] Assignee: Consolidation Coal Co., Pittsburgh, Pa.

[21] Appl. No.: 925,759

[22] Filed: Oct. 31, 1986

[51] Int. Cl.[4] ..... F26B 21/06

[52] U.S. Cl. ..... 34/25; 34/31; 34/48; 34/56

[58] Field of Search ..... 34/48, 56, 164, 31, 34/32, 25

[56] References Cited

U.S. PATENT DOCUMENTS 3,186,102 6/1985 Brociner et al. ..... 34/56

4,305,210 12/1981 Christensen et al. ..... 34/164

*Primary Examiner*—Larry I. Schwartz

*Attorney, Agent, or Firm*—Stanley J. Price; Alan N. McCartney

[57] ABSTRACT

A thermal dryer used to dry wet material includes a drying chamber and a storage bin. Material is transferred from the storage bin onto a movable support means positioned within the drying chamber. A furnace supplies hot gas to the drying chamber and the gas passes over the movable support means to dry the wet material positioned thereon. The temperature of the gas that has been passed over the wet material is automatically maintained at a preselected temperature by controlling the amount of wet material on the movable support means. The temperature of the gas that has been passed over the support means is controlled independently of the temperature of the gas supplied by the furnace. The amount of wet material in the storage bin is automatically maintained below a preselected amount by controlling the temperature of the hot gas supplied by the furnace to the drying chamber. When the amount of wet material exceeds the preselected amount, the temperature of the hot gas supplied by the furnace is increased. This results in a corresponding increase in the temperature of the gas that has been passed over the wet material. In order to reduce the temperature of the gas that has been passed over the wet material, the amount of wet material positioned on the movable support means is increased. An increase in the amount of wet material transferred from the storage bin to the movable support means results in a reduction in the amount of wet material in the storage bin.

4 Claims, 2 Drawing Figures

THERMAL DRYER CONTROL SYSTEM

BACKGROUND OF THE INVENTION

1. Field of the Invention

This invention relates to a method and apparatus for operating a thermal drying system, and more particularly, to a system for maintaining the temperature of gas that has been passed over wet material in a drying chamber at a constant temperature, and to a system for controlling the amount of wet material contained in a storage means that supplies wet material to a drying chamber.

2. Description of the Prior Art

Thermal dryers are presently utilized in many industrial operations to remove moisture from wet material and the like that must be dried before the material can be made available to consumers or other industrial operations. Thermal dryers employ different types of operating control systems, depending upon what is going to be done with the material after the material has passed through the thermal dryer.

U.S. Pat. No. 3,396,476 discloses a method for controlling the drying of alfalfa preparatory to the alfalfa being pelletized. The dehydrator comprises a rotary dryer that receives alfalfa in one end and exposes the alfalfa to hot air from a furnace. The hot air and dried alfalfa are separately discharged from the other end. The moisture content of the alfalfa introduced into the drying chamber varies substantially, yet it is necessary that the moisture content of the alfalfa after dehydration remain essentially constant. The temperature of the air within the discharge end of the dehydrator and the temperature of the discharged alfalfa, which is indicative of the moisture content, are sensed and actuate computing controllers to increase or decrease the rate at which wet alfalfa is supplied to the dehydrator. For any average rate of feed of wet alfalfa to the dehydrator, the furnace temperature and amount of hot air supplied by the furance remain constant.

U.S. Pat. No. 3,395,459 discloses an apparatus for drying wood veneer in which hot air is supplied to a drying chamber. A conveyor system is positioned inside the drying chamber. Wood veneer sheets are moved through the drying chamber on the conveyor system, and hot air supplied by a furnace is passed over the veneer sheets to remove the moisture therefrom. A temperature sensor monitors the temperature of the hot air in the drying chamber. Variations in the hot air temperature are utilized to adjust the speed of the conveyor system, resulting in an adjustment in the amount of time the veneer sheets are subjected to the hot air within the drying chamber. The conveyor system speed is regulated so that the veneer sheets remain in the drying chamber for a sufficient period of time to dry ninety percent of the sheets.

U.S. Pat. No. 3,732,435 discloses an apparatus for measuring the moisture content of material being conveyed through a machine for conditioning the material to achieve a selected moisture content, and for controlling the speed at which the material is conveyed through the machine in order to subject the material to longer or shorter periods of exposure to the conditioner for the purpose of achieving the selected moisture content for the material.

U.S. Pat. Nos. 2,136,870; 2,323,289; 2,666,269; 3,672,070; 3,732,435; 3,783,527; 4,379,692 and 4,487,577 are directed to various types of dryers, dryer feeds rotary kiln-type dryers, fluidized bed-type dryers and the like.

It has been suggested by the prior art devices to utilize temperature variations inside a drying chamber to increase or decrease either the rate at which wet material is supplied to a drying chamber or the rate at which wet material is passed through a drying chamber, to control the moisture content of the material discharged from the drying chamber. There is a need for a method and apparatus to control the temperature variations inside a drying chamber, and more particularly, for a method and apparatus to maintain the temperature inside a drying chamber at a constant preselected temperature. The temperature inside the drying chamber is maintained at the constant preselected temperature by automatically controlling the amount of wet material introduced into the drying chamber. There is also need for a method and apparatus for controlling the amount of wet material contained in a storage means that supplies wet material to a drying chamber. The amount of wet material contained in the storage means is regulated by controlling the drying capacity of the drying chamber.

SUMMARY OF THE INVENTION

In accordance with the present invention, there is provided a method and apparatus for automatically controlling the exhaust gas temperature of a thermal drying system that includes a drying chamber and a support means positioned inside the drying chamber. Wet material is deposited on the support means, and as the wet material is moved on the support means, hot gas delivered from a source is introduced into the drying chamber and passed over the support means to dry the wet material positioned thereon. The temperature of the gas that has been passed over the support means is maintained at a constant preselected temperature by automatically controlling the amount of wet material deposited on the support means and subjected to the hot gas supplied by the source. The temperature of the hot gas that has been passed over the wet material is regulated independently of the temperature of the hot gas supplied by the source.

Further in accordance with the present invention, there is provided a method and apparatus for automatically controlling the amount of wet material in a storage means to be dried by a thermal drying system that includes a storage means and a drying chamber. Wet material is fed into the storage means, and the amount of wet material in the storage means is continually measured. Wet material is withdrawn from the storage means and deposited onto a support means positioned inside the drying chamber. Hot gas delivered from a source is introduced into the drying chamber and passed over the support means to dry the wet material positioned thereon. The temperature of the gas that has been passed over the support means is maintained at a constant preselected temperature by automatically controlling the amount of wet material deposited on the support means and subjected to the hot gas supplied by the source. If the amount of wet material in the storage means exceeds a preselected amount, the temperature of the hot gas delivered from the source is increased, causing an increase in the temperature of the gas that has been passed over the support means. The temperature of the gas that has been passed over the support means will increase until it exceeds the preselected temperature. The amount of wet material transferred from the storage means to the support means will increase to reduce the temperature of the gas that has been passed over the support means to the preselected temperature, resulting in a corresponding reduction in the amount of wet material in the storage means to the preselected amount.

Accordingly, the principle object of the present invention is to provide a method and apparatus for maintaining the exhaust gas temperature of a thermal drying system at a constant preselected temperature by controlling the amount of wet material positioned on a movable support means within a drying chamber that is subjected to hot gas supplied by a source to the drying chamber.

Another object of the present invention is to provide a method and apparatus for controlling the inventory of wet material maintained in a storage means by controlling the drying capacity of the drying chamber.

These and other objects of the present invention will be more completely disclosed and described in the following specifications, the accompanying drawings and the appended claims.

DESCRIPTION OF THE PREFERRED EMBODIMENTS

Figure 1:
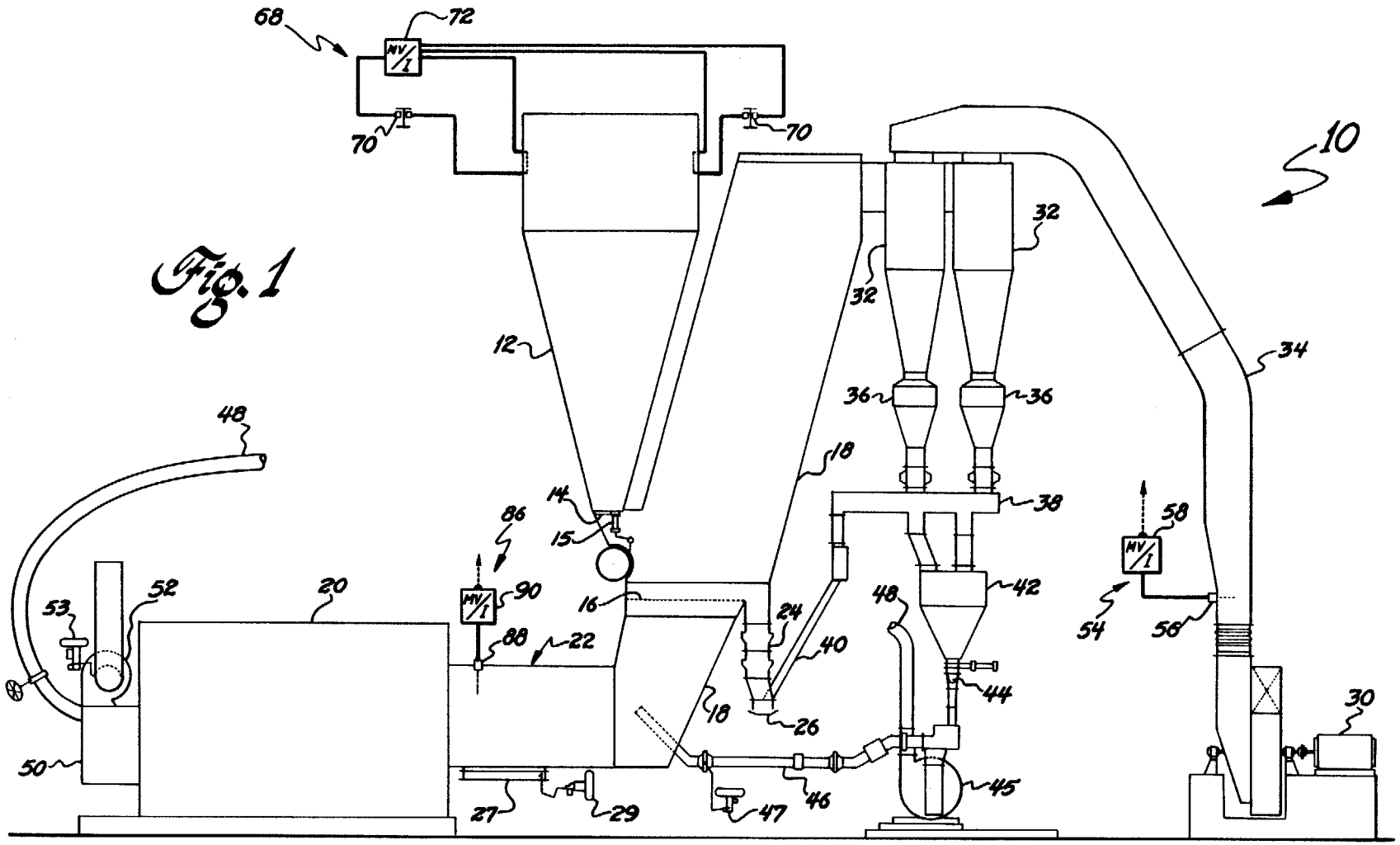
FIG. 1 is a schematic diagram of a coal fired thermal drying system for use in mining operations to dry coal.

Referring to FIG. 1, there is illustrated a coal fired thermal dryer generally designated by the numeral 10 for use in mining operations to dry wet coal. The wet coal is placed in storage means 12, which includes a movable feedgate 14. Feedgate 14, located at the bottom of storage means 12, operates to transfer coal within storage means 12 onto a movable support means or conveyor, diagramatically illustrated as 16. Movable support means 16 is positioned inside drying chamber 18. Furnace 20 supplies hot gas which passes through hot gas duct 22 and into drying chamber 18. The hot gas passes over support means 16 to dry the wet coal positioned on support means 16. Coal is discharged from support means 16 through collecting chute 24 onto conveyor 26.

After the hot gas supplied by furnace 20 passes over support means 16 to dry the wet coal positioned thereon, it is drawn upwardly into drying chamber upper portion 28 by exhaust fan 30. The gas passes through two separators 32 to remove any coal particulates suspended in the gas. After the coal particulates are separated from the gas, the gas passes through exhaust line 34 and into another portion of the system (not shown) for further treatment. The particulates collected inside separators 32 are deposited into two dust bins 36. A portion of the coal particulates contained within dust bins 36 are transferred by means of screw conveyor 38 through chute 40 onto conveyor 26. The remaining portion of the coal particulates contained in dust bins 36 are deposited into pulverizer feed bin 42 into pulverizer 45. Pulverizer 45 further reduces the coal particulates to a preselected size.

A portion of the hot gas supplied by furnace 20 and introduced into drying chamber 18 is directed through primary air line 46 into pulverizer 45 to propel the coal particulates within pulverizer 45 into supply pipe 48. The coal particulates in supply pipe 48 are introduced into furnace burner 50. The particulates in furnace burner 50 mix with air supplied by inlet fan 52 to provide the coal-air mixture for combustion in furnace 20.

In accordance with the present invention, it is desired that the temperature of the gas in exhaust line 34 be automatically maintained at a preselected temperature. Further, it is desired that the temperature of the gas in exhaust line 34 be controlled independently of the temperature of the hot gas supplied by furnace 20 and introduced into drying chamber 18. The preselected temperature of the gas in exhaust line 34 is referred to as the setpoint. The temperature of the gas in exhaust line 34 is maintained at the setpoint by automatically controlling the amount of wet coal on movable support means 16 that is subjected to the hot gas supplied by furnace 20 and introduced into drying chamber 18. An increase in the amount of wet coal on movable support means 16 will cause the temperature of the gas in exhaust line 34 to decrease, since the hot gas supplied by furnace 20 will pass over an increased amount of wet coal in drying chamber 18. As the hot gas passes over movable support means 16 carrying this increased amount of wet coal, additional moisture contained in the increased amount of wet coal will act to cool the gas. Conversely, a decrease in the amount of wet coal on movable support means 16 will cause the temperature of the gas in exhaust line 34 to increase, since the hot gas supplied by furnace 20 will pass through a decreased amount of wet coal on movable support means 16.

The temperature of the gas in exhaust line 34 is measured by temperature sensor 54. Temperature sensor 54 includes a thermocouple 56 and a signal converter 58. Thermcouple 56 extends into exhaust line 34 to continually measure the temperature of the gas within exhaust line 34. Thermocouple 56 produces a millivolt signal proportional to the gas temperature. The signal produced by thermocouple 56 provides a signal to converter 58. Signal converter 58 converts the millivolt signal produced by thermocouple 56 into a milliamp signal directly proportional to the millivolt signal. As described, the milliamp signal produced by signal converter 58 is porportional to the gas temperature within exhaust line 34.

Figure 2:
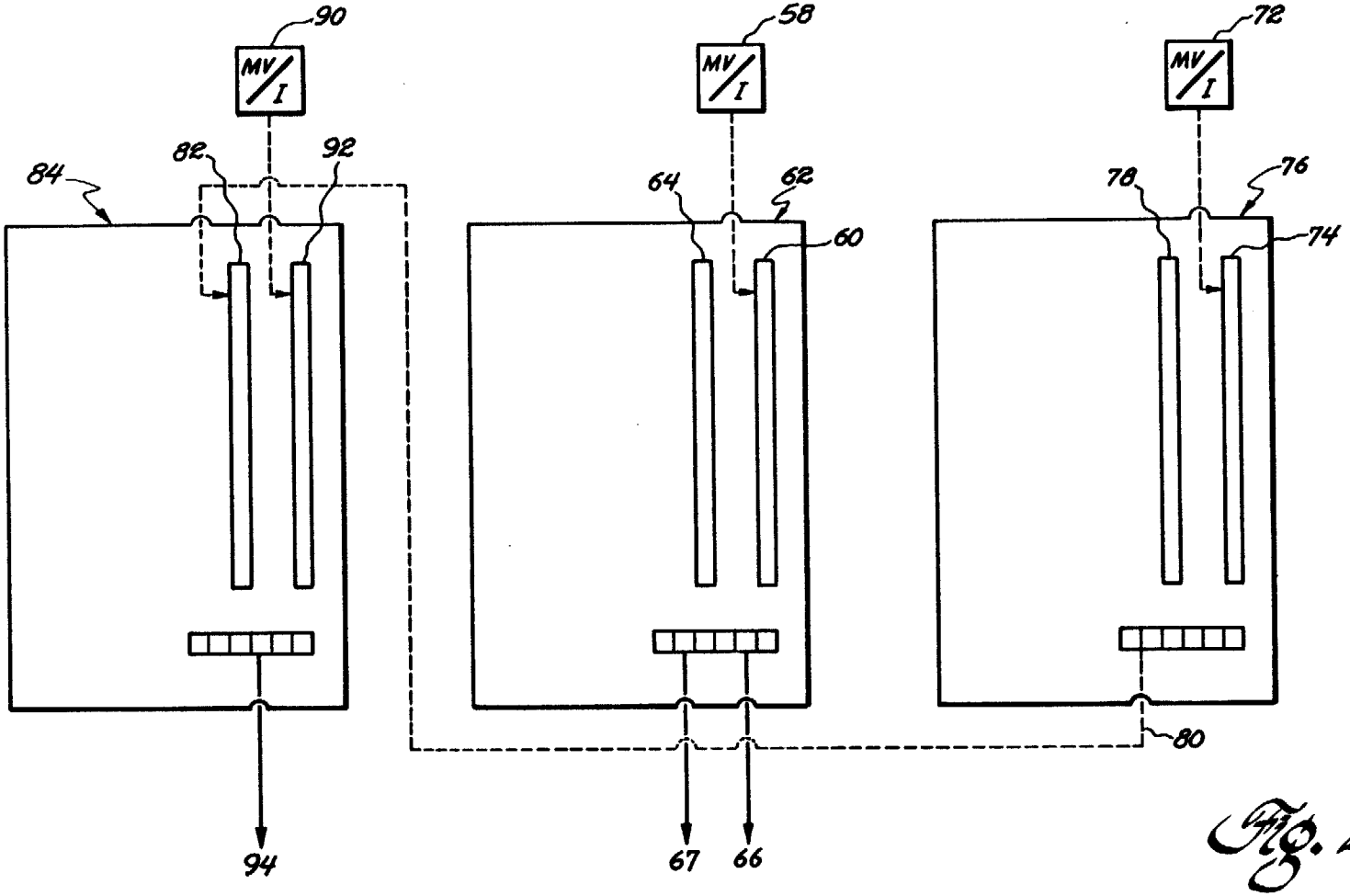
FIG. 2 is a schematic diagram of the control loops used to practice this invention.

The milliamp signal produced by signal converter 58, corresponding to the actual temperature of the gas in exhaust line 34, provides a signal to process portion 60 of exhaust temperature processor 62, shown in FIG. 2. Processor 62 is a commercially available unit, such as a Moore Products Company Processor, Model 352E. Exhaust temperature processor 62 also includes setpoint portion 64. The preselected temperature of the gas in exhaust line 34, or setpoint, is entered into setpoint portion portion 64 by the system operator.

The setpoint entered into setpoint portion 64 is continually compared within exhaust temperature processor 62 to the signal provided to process portion 60 by signal converter 58. The signal provided to process portion 60 corresponds to the actual gas temperature in exhaust line 34. If the process portion signal is greater than the setpoint, this indicates that the temperature of the gas in exhaust line 34 has exceeded the setpoint. Exhaust temperature processor 62 provides an output signal 66 to feedgate operator 15, shown in FIG. 1, to further open feedgate 14 and increase the amount of wet coal on support means 16. Since hot gas supplied by furnace 20 and introduced into drying chamber 18 must pass over this increased amount of wet coal, the temperature of the gas in exhaust line 34 is reduced.

Conversely, if the signal provided to process portion 60 by signal converter 58 is less than the setpoint entered into setpoint portion 64, this indicates that the temperature of the gas in exhaust line 34 has fallen below the setpoint. Exhaust temperature processor 62 provides an output signal 66 to feedgate operator 15, shown in FIG. 1, to partially close feedgate 14 and decrease the amount of wet coal on support means 16. Since the hot gas supplied by furnace 20 passes over a decreased amount of wet coal on support means 16, the temperature of the gas in exhaust line 34 is increased.

As described, the temperature of the gas in exhaust line 34 is maintained at a preselected temperature, or setpoint, by automatically controlling the operation of feedgate 14 to allow more or less wet coal to pass across support means 16. The temperature of the gas in exhaust line 34 is controlled independently of the temperature of the hot gas produced by furnace 20.

The thermal dryer shown in FIG. 1 includes a safety system which operates to protect drying chamber 18 and exhaust line 34 from heat damage in the event that the temperature of the gas in exhaust line 34 exceeds a maximum preselected temperature. As previously described, the actual temperature of the gas in exhaust line 34 is measured by thermocouple 56. The millivolt signal produced by thermocouple 56 corresponding to the gas temperature provides a signal to signal converter 58. The milliamp signal produced by signal converter 58 provides a signal to process portion 60 of exhaust temperature processor 62, shown in FIG. 2. Process portion 60 of exhaust temperature processor 62 includes a maximum preselected temperature setpoint. The maximum preselected temperature setpoint is entered into process portion 60 by the system operator. If the signal produced by signal converter 58 and provided to process portion 60 exceeds the maximum preselected temperature setpoint, this indicates that the actual gas temperature in exhaust line 34 has risen to a level that may cause heat damage to both drying chamber 18 and exhaust line 34. Whenever the signal produced by signal converter 58 and provided to process portion 60 exceeds the maximum preselected temperature setpoint, exhaust temperature processor 62 provides a damper signal 67 to tempering air damper controller 29, shown in FIG. 1. Tempering air damper controller 29 operates to fully open tempering air damper 27 to allow cold air to enter hot gas duct 22. As cold air is introduced into hot gas duct 22, it acts to cool the hot gas supplied to drying chamber 18 so that the temperature of the gas in drying chamber 18 and exhaust line 34 is reduced to a safe temperature level.

Further in accordance with the present invention, it is desired that the amount of wet coal within storage means 12 is automatically maintained below a preselected weight. The weight of the wet coal in storage means 12 is continually measured by a storage means weight sensor 68, shown in FIG. 1. Storage means weight sensor 68 includes two strain guages 70 and one signal converter 72. The weight of the wet coal in storage means 12 is measured by two strain guages 70. Each strain guage 70 produces a millivolt signal proportional to the weight of the wet coal in storage means 12. Strain guages 70 provide millivolt signals to signal converter 72 that converts the millivolt signals generated by strain guages 70 into a milliamp signal. As described, the milliamp signal produced by signal converter 72 is proportional to the weight of the wet coal in storage means 12.

The milliamp signal produced by signal converter 72 corresponding to the exact weight of the wet material in storage means 12 provides a signal to process portion 74 of storage level processor 76 shown in FIG. 2. Processor 76 is a standard, commercially available unit, such as a Moore Products Company Processor, Model 352B. Storage level processor 76 also includes a setpoint portion 78. The preselected weight is entered into setpoint portion 78 by the system operator. The preselected weight entered into setpoint portion 78 is continually compared within processor 76 to the signal provided to process portion 74 by signal converter 72. If the signal produced by signal converter 72 and provided to process portion 74 is greater than the preselected weight entered into setpoint portion 78, this indicates that the weight of the wet coal in storage means 12 has exceeded the preselected weight.

The weight of the wet coal within storage means 12 is reduced by providing a storage level processor output signal 80 whenever the exact weight of the wet coal in storage means 12 exceeds the preselected weight. Output signal 80 is provided to setpoint portion 82 of furnace temperature processor 84 shown in FIG. 2. Furnace temperature processor 84 is a standard, commercially available unit, such as a Moore Products Company Processor, Model 352E. Furnace temperature processor 84 controls the temperature of the hot gas produced by furnace 20.

The temperature of the hot gas produced by furnace 20 is measured by furnace temperature sensor 86, shown in FIG. 1. Furnace temperature sensor 86 includes a thermocouple 88 and a signal converter 90. Thermocouple 88 is mounted inside hot gas duct 22. As the hot gas produced by furnace 20 passes through hot gas duct 22, thermocouple 88 measures the temperature of the hot gas. Thermocouple 88 produces a millivolt signal proportional to the gas temperature in hot gas duct 22. Thermocouple 88 provides a signal to signal converter 90 that converts the millivolt signal produced by thermocouple 88 into a milliamp signal. As described, the milliamp signal produced by signal converter 90 is proportional to the temperature of the hot gas produced by furnace 20.

Signal converter 90 provides a signal to process portion 92 of furnace temperature processor 84, shown in FIG. 2. The signal provided to process portion 92 by signal converter 90, corresponding to the exact temperature of the hot gas supplied by furnace 20, is continually compared within furnace temperature processor 84 to output signal 80 provided to setpoint portion 82. As previously described, signal 80 is provided to setpoint portion 82 of furnace temperature processor 84 whenever the exact weight of the wet coal in storage means 12 exceeds the preselected weight. Since the exact weight of the wet coal in storage means 12 exceeds the preselected weight, the output signal 80 provided to setpoint portion 82 of furnace temperature processor 84 is greater than the signal produced by signal converter 90 and provided to process portion 92 of furnace temperature processor 84. Because the setpoint portion signal is greater than the process portion signal, furnace temperature processor 84 provides an output signal 94 to increase the temperature of the hot gas produced by furnace 20. Output signal 94 produced by furnace temperature processor 84 provides a signal to fan controller 53, shown in FIG. 1, screw conveyor 44 and primary air line controller 47 to increase the respective amounts of combustion elements introduced in furnace burner 50. As a result, the temperature of the hot gas supplied by furnace 20 to drying chamber 18 is increased.

As long as the output signal 80 produced by storage level processor 76 and provided to furnace temperature processor setpoint portion 82 is greater than the signal produced by signal converter 90 and provided to process portion 92, furnace 20 will continue to supply hot gas to drying chamber 18 at an increased temperature. This will result in a corresponding increase in the temperature of the gas in exhaust line 34. The temperature of the gas in exhaust line 34 will increase and eventually exceed the setpoint, or preselected temperature. In order to reduce the gas temperature in exhaust line 34 to the setpoint, exhaust temperature processor 62 provides an output signal 66 to feedgate operator 15, shown in FIG. 1, to further open feedgate 14 and increase the amount of wet coal on support means 16. As exhaust temperature processor 62 operates to reduce the gas temperature in exhaust line 34 by increasing the amount of wet coal transferred from storage means 12 to movable support means 16, the weight of the wet coal in storage means 12 is reduced. Furnace temperature processor 84 will continue to provide an output signal 94 to increase the temperature of the hot gas produced by furnace 20 until the actual weight of the wet coal in storage means 12 is reduced to the preselected weight. When the actual weight of the wet coal in storage means 12 is reduced to the preselected weight, storage level processor 76 provides an output signal 80 to setpoint portion 82 of furnace temperature processor 84 that is less than the signal provided to process portion 92 by signal converter 90. Furnace temperature processor 84 produces an output signal 94 to reduce the temperature of the hot gas produced by furnace 20. As described, the weight of the wet coal in storage means 12 is controlled by varying the temperature of the hot gas produced by furnace 20. If the weight of the wet coal exceeds a preselected amount, the temperature of the hot gas produced by furnace 20 is increased, resulting in a corresponding increase in the temperature of the gas in exhaust line 34. When the temperature of the gas in exhaust line 34 increases above the preselected temperature, or setpoint, an increased amount of wet coal is transferred from storage means 12 onto movable support means 16, causing a decrease in the weight of the wet coal in storage means 12. The increase in the amount of wet coal on movable support means 16 results in a corresponding decrease in the temperature of the gas in exhaust line 34.

According to the provisions of the Patent Statutes, I have the explained the principle, preferred construction, and mode of operation of my invention and have illustrated and described what I now consider to represent its best embodiments. However, it should be understood that, within the scope of the appended claims, the invention may be practiced otherwise than as specifically illustrated and described.

I claim:

1. A method for controlling the weight of wet material in a storage means to be dried by a thermal drying system comprising the steps of, feeding wet material into a storage means, withdrawing said wet material from said storage means, introducing said wet material onto a support means within a drying chamber, moving said support means within said drying chamber with said wet material positioned thereon, passing hot gas delivered from a source over said wet material, measuring the temperature of said hot gas after said hot gas has passed over said wet material on said support means, regulating the temperature of said hot gas after said hot gas has passed over said wet material to a preselected temperature independently of the temperature of said hot gas delivered from said source by controlling the amount of wet material introduced onto said support means within said drying chamber, continually measuring the weight of said wet material within said storage means, increasing the temperature of said hot gas delivered from said source when said wet material weight exceeds a predetermined amount, so that the temperature of said hot gas after said hot gas passes over said wet material exceeds said preselected temperature, and increasing the amount of said wet material introduced onto said support means within said drying chamber to control said temperature of said hot gas after said hot gas passes over said wet material to said preselected temperature and thereby reducing the weight of said wet material within said storage means to said predetermined amount.

2. A method for controlling the weight of wet material in a storage means to be dried by a thermal drying system as set forth in claim 1 including the further steps of, providing weight sensor means to continually measure the weight of said wet material within said storage means, said weight sensor means producing a signal proportional to the weight of said wet material within said storage means, providing said weight sensor means signal to a processor means, comparing said weight sensor means signal to a preselected weight signal within said processor means, and increasing the temperature of said hot gas delivered from said source when said weight sensor means signal is greater than said preselected weight signal so that the temperature of said hot gas after said hot gas passes over said wet material exceeds said preselected temperature.

3. Apparatus for controlling the weight of wet coal in a feed bin to be dried by a thermal drying system comprising, a feed bin containing wet coal, a support means positioned within a drying chamber, means for withdrawing said wet coal from said feed bin and introducing said wet coal onto said support means, means for moving said support means within said drying chamber with said wet material positioned thereon, furnace means for supplying hot gas to said drying chamber to dry said wet coal on said support means, thermocouple means for measuring the temperature of said hot gas after said hot gas has passed over said wet coal, means for regulating the temperature of said hot gas after said hot gas has passed over said wet coal to a preselected temperature independently of the temperature of said hot gas delivered from said furnace means by controlling the amount of wet coal introduced onto said support means within said drying chamber, means for continually measuring the weight of said wet coal within said feed bin, control means for increasing the temperature of said hot gas delivered from said furnace means when said weight of said wet coal exceeds a predetermined amount, so that said temperature of said hot gas after said hot gas passes over said wet coal exceeds said preselected temperature, and means for increasing the amount of wet coal introduced onto said support means within said drying chamber to control said temperature of said hot gas after said hot gas passes over said wet coal to said preselected temperature to thereby reduce the weight of said wet coal within said feed bin to said predetermined amount.

4. Apparatus for controlling the weight of wet coal in a feed bin to be dried by a thermal drying system as set forth in claim 3 including, weight sensor means for continually measuring the weight of said wet coal within said feed bin, said weight sensor means producing a signal proportional to the weight of said wet coal within said feed bin, processor means having an input for receiving said weight sensor means signal and an input for receiving a preselected weight signal, said processor means including means for comparing said weight sensor means signal to said preselected weight signal, and said processor means providing an output signal to said control means when said weight sensor means signal is greater than said preselected weight signal, said output signal operable within said control means to increase the temperature of said hot gas delivered from said furnace means so that said temperature of said hot gas after said hot gas passes over said wet coal exceeds said preselected temperature.

* * * * *

UNITED STATES PATENT OFFICE
CERTIFICATE OF CORRECTION

PATENT NO. : 4,713,893

DATED : December 22, 1987

INVENTOR(S) : Frederick A. Webb

It is certified that error appears in the above-identified patent and that said Letters Patent are hereby corrected as shown below:

Column 3, lines 62-64 should read:

--are deposited into pulverizer feed bin 42. Screw conveyor 44 transfers the coal particulates from pulverizer feed bin 42 into pulverizer 45. Pulverizer 45 further reduces the coal particulates to a preselected size.--

Signed and Sealed this

Seventh Day of June, 1988

*Attest:*

*Attesting Officer*

DONALD J. QUIGG

*Commissioner of Patents and Trademarks*